US008439473B2

(12) United States Patent
Iriguchi et al.

(10) Patent No.: US 8,439,473 B2
(45) Date of Patent: May 14, 2013

(54) IMAGE RECORDING APPARATUS

(75) Inventors: Akira Iriguchi, Ichinomiya (JP); Tomohiro Nodsu, Seto (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 280 days.

(21) Appl. No.: 12/890,077

(22) Filed: Sep. 24, 2010

(65) Prior Publication Data

US 2011/0074846 A1 Mar. 31, 2011

(30) Foreign Application Priority Data

Sep. 29, 2009 (JP) ..... 2009-224682

(51) Int. Cl.
*B41J 2/205* (2006.01)
*B41J 29/38* (2006.01)

(52) U.S. Cl.
USPC ..... 347/15; 347/9; 347/12

(58) Field of Classification Search ..... None
See application file for complete search history.

(56) References Cited

U.S. PATENT DOCUMENTS

2008/0074455 A1* 3/2008 Yoshida et al. ..... 347/15
2009/0002414 A1 1/2009 Shibata et al.

FOREIGN PATENT DOCUMENTS

JP 11-314382 11/1999
JP 2004-195749 7/2004
JP 2004-209943 7/2004
JP 2006-256009 9/2006
JP 2009-029118 2/2009

OTHER PUBLICATIONS

Notice of Reasons for Rejection issued for Japanese Patent Application No. 2009-224682 dated Jan. 29, 2013.

* cited by examiner

*Primary Examiner* — Geoffrey Mruk
(74) *Attorney, Agent, or Firm* — Frommer Lawrence & Haug LLP

(57) ABSTRACT

An ink-jet printer includes an ink jet head which jets liquid droplets of an ink onto a recording medium; a scanning mechanism which reciprocates the ink-jet head in a forward scan direction and a backward scan direction; a transport mechanism which transports the recording medium in a transport direction intersecting with the forward and backward scan directions; and a jetting controller which controls the ink-jet head. The jetting controller has a reference jetting amount setting section which sets a reference jetting amount based on an input image data for each of a plurality of scans of the ink-jet head, and a jetting amount adjusting section which makes a jetting amount be smaller than the reference jetting amount with respect to an overlapping area at which liquid droplet jetting areas of the forward scan and the backward scan partially overlap each other.

9 Claims, 11 Drawing Sheets

IMAGE RECORDING APPARATUS

CROSS REFERENCE TO RELATED APPLICATION

The present application claims priority from Japanese Patent Application No. 2009-224682 filed on Sep. 29, 2009, the disclosures of which are incorporated herein by reference in their entirety.

BACKGROUND OF THE INVENTION

1. Field of the Invention

The present invention relates to an image recording apparatus which records an image by jetting ink droplets to a recording medium.

2. Description of the Related Art

A common ink jet printer has an ink jet head which is provided on a carriage movable in a reciprocating manner in a predetermined scanning direction over a recording medium such as recording paper and the like and which jets ink(s) from a plurality of nozzles, and a transport mechanism which transports the recording medium in a transport direction perpendicular to the scanning direction. The printer alternately repeats an operation of jetting inks toward the recording medium while moving the ink jet head in the scanning direction, and another operation of transporting the recording medium in the transport direction by a predetermined transport amount or distance so as to record a desired image on the recording medium (for example, see Japanese Patent Application Laid-Open No. 2004-195749).

Here, as a method of image recording by the above-described ink jet printer, the following two methods are known: the method of jetting inks from the ink jet head only when the carriage moves in one of the scanning directions (single direction printing); and the method of jetting inks from the ink-jet head in both of the reciprocating scans of the carriage respectively (dual direction printing). Further, in the dual direction printing, there is also widely known a printing method in which dots are formed with a shorter interval than the nozzle layout interval in the transport direction, and thus an area to which liquid droplets are jetted in a preceding scan partially overlaps another area to which liquid droplets are jetted in the succeeding scan carried out after the scanning direction is reversed, so as to realize a high print resolution in the transport direction.

SUMMARY OF THE INVENTION

However, in the case that the liquid droplet jetting areas overlap each other through the preceding and succeeding scans as described above, problems as below may occur.

As shown in FIG. 11A, in the area where the liquid droplet jetting areas partially overlap each other through the preceding and succeeding scans, if the ink Ib jetted in the succeeding scan is overlaid on the ink Ia which is landed in the preceding scan and which is in a state of being not yet sufficiently dried, a large part of the succeeding ink Ib may penetrate into the recording medium 100 from the periphery of the dots (the undried ink Ia) formed previously. In other words, the amount of the ink Ib fixed on the preceding ink Ia (the heavy line portions of FIG. 11A) may be lessened. Therefore, the print density may become lower in the portions where the preceding ink Ia is overlapped with the succeeding ink Ib in comparison with the case that the preceding ink Ia is dried. On the other hand, as shown in FIG. 11B, when the ink Ia landed in the preceding scan is almost dried, it is easier for the succeeding ink Ib to fix on the preceding ink Ia, thereby reducing the amount of the ink penetrating into the recording medium 100. Thus, the print density becomes higher in the portions where the preceding ink Ia is overlapped with the succeeding ink Ib in comparison with the case that the preceding ink Ia is not sufficiently dried. In this manner, the print density of the portion where the early landed ink is overlapped with the later landed ink varies depending on the dry condition of the ink landed in the preceding scan at the time right before landing of the ink jetted in the succeeding scan.

Further, FIG. 12 shows a shading of an image formed on the recording medium 100 when three consecutive scans by the ink-jet head S1 to S3 are carried out. In FIG. 12, hatching is made only in the areas where two scans overlap (S1 and S2; S2 and S3). It can be seen that as coming closer to the positions where the scanning direction is reversed (the right edge of S1→S2 reverse and the left edge of S2→S3 reverse), the ink of the succeeding scans is more likely to land on the ink of the preceding scans (S1 prior to S2; S2 prior to S3) still remaining in an almost undried state; thereby the density becomes extraordinarily low in the vicinity of the reverse positions. That is, because the dry condition of the preceding ink is not uniform in the scanning direction at the time right before the succeeding ink is landed, the shading occurs as shown in FIG. 12 and thus lowers the print quality.

Here, in the ink-jet printer described in Japanese Patent Application Laid-Open No. 2004-195749, when the scanning direction is reversed, a flushing process of the ink-jet head is always carried out at a position at which the ink-jet head does not face the recording paper (recording medium). By virtue of this, because the preceding ink gets in progress of drying during the period of the flushing process after the preceding scan is finished and before the succeeding scan is started, the occurrence of shading from the difference in dry condition of the preceding ink is restrained.

With respect to the ink jet printer described in Japanese Patent Application Laid-Open No. 2004-195749, because flushing is consistently carried out during the period between the preceding scan and the succeeding scan, it is possible to secure a certain period of drying time or more for the preceding ink. Nevertheless, the time for image printing (recording) may accordingly become longer at the same rate. That is, the print speed (image recording speed) becomes slow and is not thus suitable for high-speed image printing.

Accordingly, an object of the present invention is to provide an image recording apparatus capable of restraining the shading of image resulted from the nonuniformity in dry condition of the ink jetted in a preceding scan without lowering the print speed.

According to a first aspect of the present invention, there is provided an image recording apparatus which records an image by jetting liquid droplets of an ink onto a recording medium, the apparatus including: an ink-jet head which jets the liquid droplets of the ink onto the recording medium; a scanning mechanism which reciprocates the ink-jet head in a forward scan direction and a backward scan direction to perform forward scan and backward scan of the ink jet head; a transport mechanism which transports the recording medium in a transport direction intersecting with the forward scan direction and the backward scan direction; and a jetting controller which controls the ink jet head to jet the liquid droplets during the forward scan and the backward scan of the ink jet head, and a transporting amount of the recording medium by the transport mechanism is set to be smaller than a length in the transport direction of a first jetting area, which is formed on the recording medium by the forward scan of the ink-jet head, the transporting amount being adopted when scanning direction of the ink-jet head is changed from the forward scan direction to the backward scan direction, so that the first jetting area is partially overlapped with a second jetting area which is to be formed on the recording medium by the backward scan of the ink-jet head in the transport direction, and the jetting controller has a reference jetting amount setting section which sets a reference jetting amount of the liquid droplets based on an input image data for each of the forward scan and the backward scan of the ink jet head performed when the image is to be recorded on the recording medium, and a jetting amount adjusting section which makes a jetting amount of the liquid droplets during the forward scan of the ink jet head be smaller than the reference jetting amount with respect to an overlapping area at which the first jetting area is overlapped with the second jetting area.

According to the present invention, when the liquid droplet jetting areas on the recording medium partially overlap each other through a forward scan and a backward scan of the ink jet head, with respect to the preceding (forward) scan, the jetting amount is made smaller than the reference jetting amount set based on the image data for the area in which the liquid droplet jetting area overlaps that of the succeeding scan. By virtue of this, the portion becomes wider on which ink does not land in the preceding scan. Thereby, it becomes easier for the ink jetted in the succeeding scan to directly land on the recording medium without overlapping much of the preceding ink. In this manner, by reducing the amount of ink overlapping the ink jetted previously among the ink jetted in the succeeding scan, even if the dry degree of the preceding ink is not uniform in the scanning direction, it is possible to reduce the influence on the fixing of the succeeding ink, and thereby to restrain shading in the image. Further, when the moving direction of the ink-jet head changes, since it is not necessary to take extra drying time for drying the ink jetted in the preceding scan, the print speed does not slow down, thereby being most suitable for image recording with a high speed.

DESCRIPTION OF THE PREFERRED EMBODIMENT

Hereinafter, a preferred embodiment of the present invention will be described. In the embodiment, the present invention is applied to an ink-jet printer which discharges ink droplets from an ink jet head to recording paper to record a desired image on the recording paper.

Figure 1:
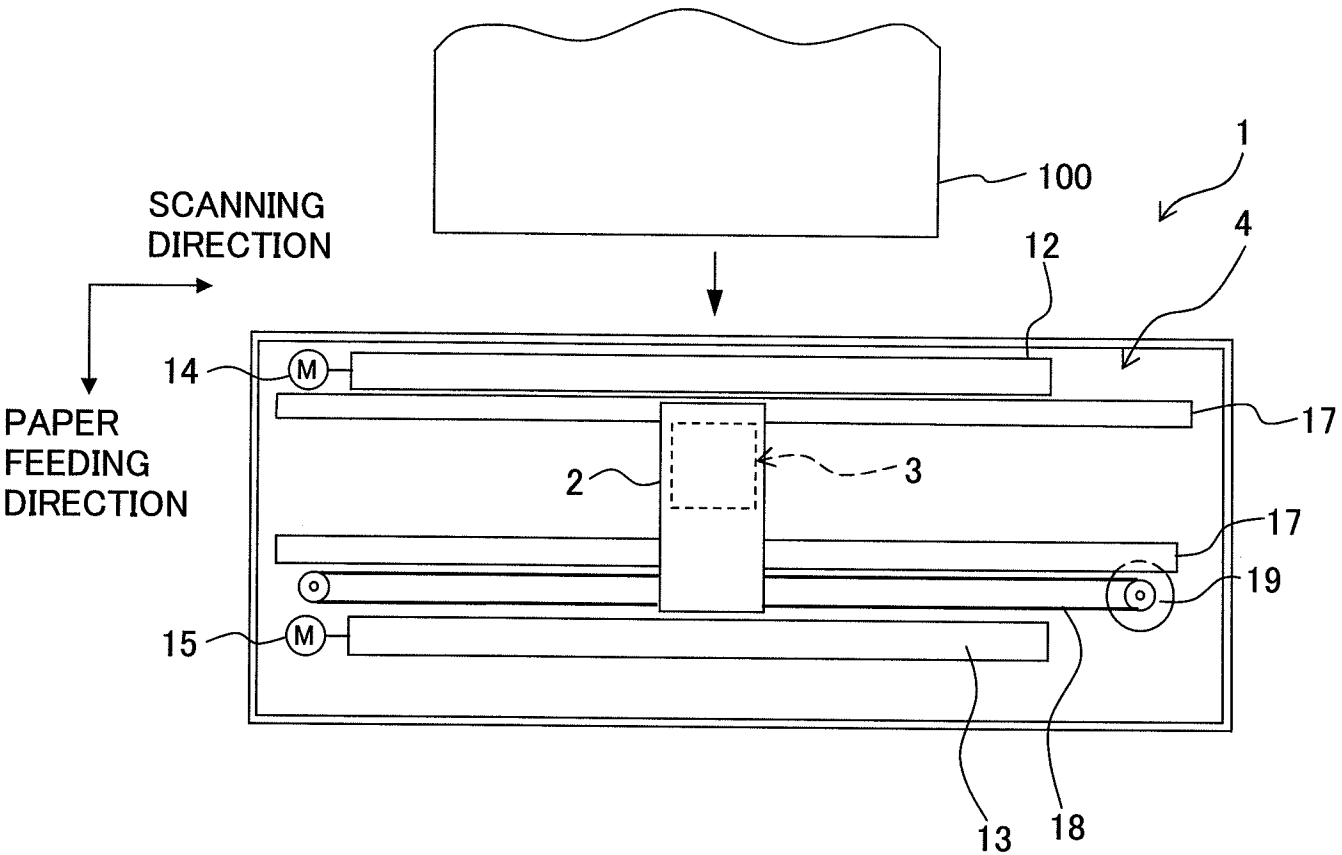
FIG. 1 is a plan view showing a schematic construction of an ink-jet printer as an example of the image recording apparatus in accordance with an embodiment of the present invention.
Figure 2:
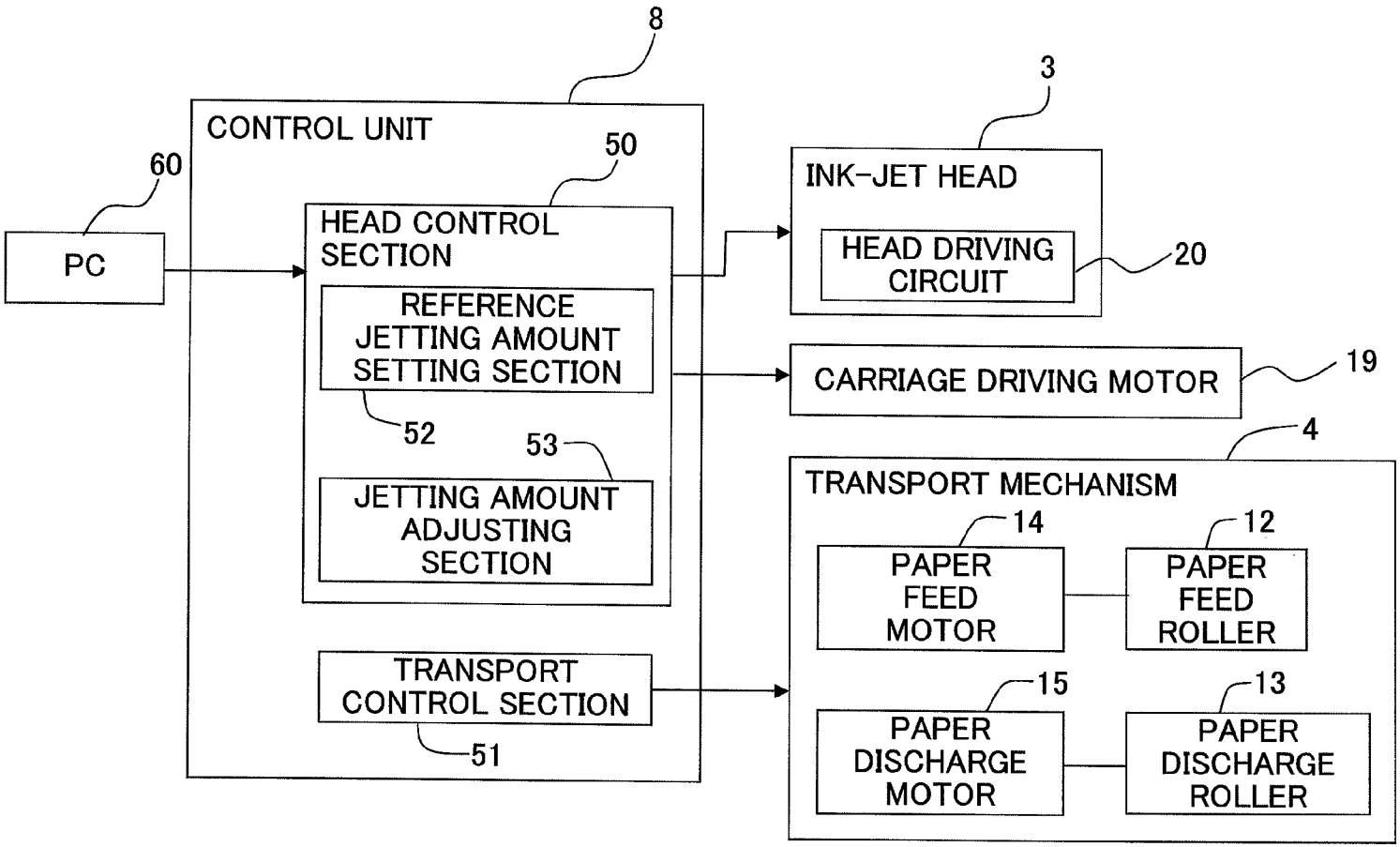
FIG. 2 is a block diagram showing a control system of the ink-jet printer of FIG. 1.

As shown in FIGS. 1 and 2, an ink-jet printer 1 (image recording apparatus) includes a carriage 2 which is movable in a reciprocating manner along a predetermined scanning direction (left-right direction of FIG. 1), an ink-jet head 3 which is provided on the carriage 2, a transport mechanism 4 which transports the recording paper 100 (recording medium) in a transport direction perpendicular to the scanning direction, a control unit 8 which controls each section of the printer 1 (see FIG. 2), and the like.

The carriage 2 is constructed to be movable in a reciprocating manner along two guide frames 17 extending parallel to the scanning direction (left-right direction of FIG. 1). Further, an endless belt 18 is connected to the carriage 2 such that the carriage 2 is moved in the scanning direction along with the travel of the endless belt 18 when the endless belt 18 is driven to travel by a carriage driving motor 19.

The ink-jet head 3 is provided on the carriage 2 and is movable integrally with the carriage 2 in a reciprocating manner in the scanning direction. Further, the carriage driving motor 19, which drives the carriage 2 provided with the ink-jet head 3 to move in the scanning direction, corresponds to a scanning mechanism in accordance with the present invention.

Figure 3:
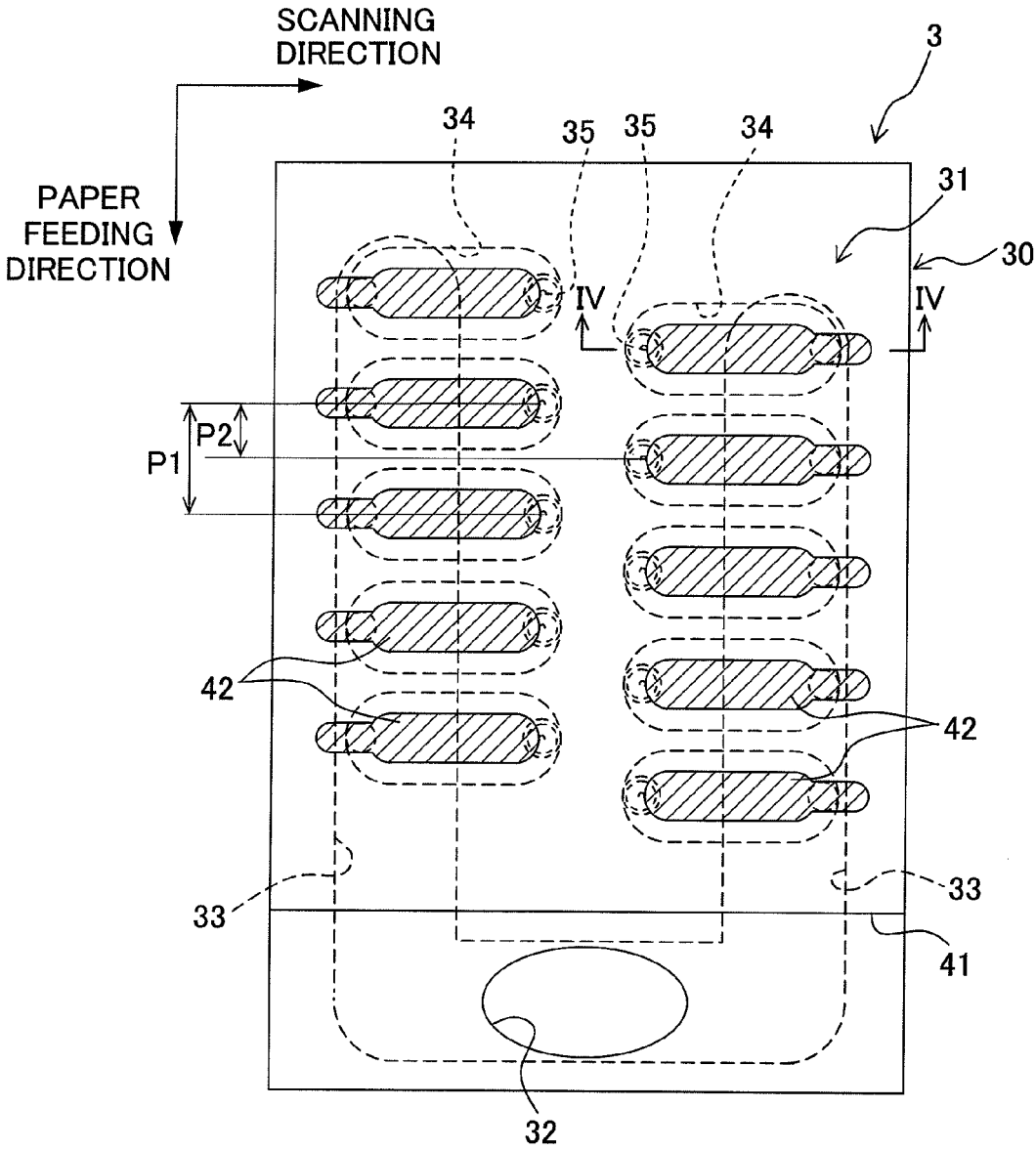
FIG. 3 is a plan view of an ink-jet head.
Figure 4:
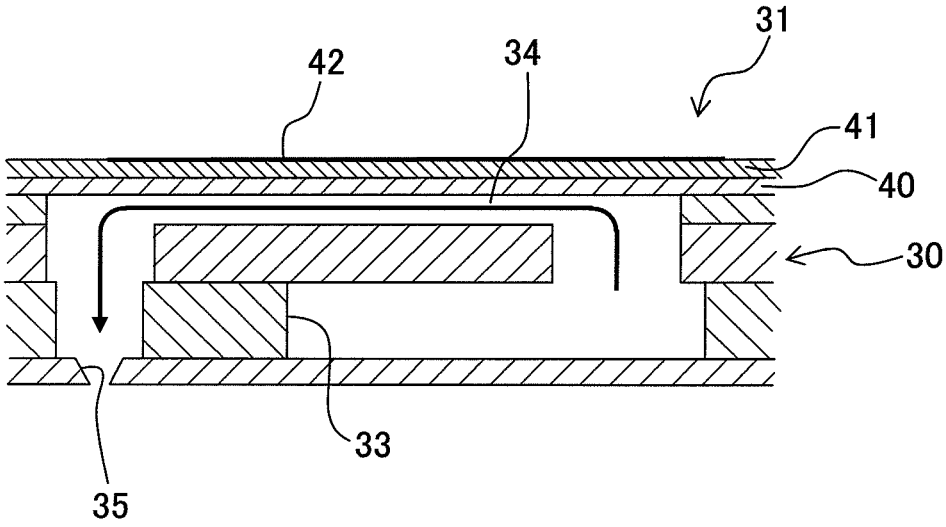
FIG. 4 is a cross-sectional view taken along the line IV-IV of FIG. 3.

As shown in FIGS. 3 and 4, the ink-jet head 3 includes a flow passage unit 30 in which ink flow passages are formed, and a piezoelectric actuator unit 31 which applies a jetting pressure to the ink inside the ink flow passages.

In the flow passage unit 30, there are formed an ink supply port 32 in connection with an ink cartridge (not shown), two manifolds 33 branching from the ink supply port 32 and extending along the transport direction, a plurality of pressure chambers 34 in communication with the manifolds 33, and a plurality of nozzles 35 in communication with the plurality of pressure chambers 34, respectively. Further, as shown in FIG. 3, the plurality of pressure chambers 34 and the plurality of nozzles 35 form two pressure chamber rows and two nozzle rows corresponding to the two manifolds 33, respectively. Further, between the two nozzle rows, the nozzles 35 are positioned off each other in the transport direction by half of the layout interval P1 in each of the rows. That is, in the embodiment, the interval between the plurality of nozzles 35 in the transport direction, i.e., the print resolution in the transport direction, is P1/2 (=P2).

The actuator unit 31 includes a vibration plate 40 which is joined to the flow passage unit 30 to cover the plurality of pressure chambers 34, a piezoelectric layer 41 which is arranged on the upper surface of the vibration plate 40, and a plurality of individual electrodes 42 which are provided on the upper surface of the piezoelectric layer 41 to correspond to the plurality of pressure chambers 34. Then, when a predetermined driving pulse signal has been supplied to an individual electrode 42 from a head driving circuit 20 (see FIG. 2), the actuator unit 31 utilizes the piezoelectric distortion occurring in the piezoelectric layer 41 to give rise to a flexural deformation in the vibration plate 40. By virtue of the flexural deformation of the vibration plate 40, the pressure chamber 34 changes in volume; thereby, a pressure is applied to the ink in the pressure chamber 34, and thus an ink droplet is discharged from the nozzle 35 in communication with the pressure chamber 34.

To return to FIG. 1, the transport mechanism 4 has a paper feed roller 12 which is arranged on the upstream side with respect to the ink-jet head 3 in the transport direction, and a paper discharge roller 13 which is arranged on the downstream side with respect to the ink-jet head 3 in the transport direction. A paper feed motor 14 and a paper discharge motor 15 drive the paper feed roller 12 and the paper discharge roller 13 to rotate, respectively. Then, the transport mechanism 4 transports the recording paper 100 from the upside of FIG. 1 toward the ink-jet head 3 by means of the paper feed roller 12 while discharging the recording paper 100 on which pictures, characters and the like are recorded by the ink-jet head 3 to the downside of FIG. 1 by means of the discharging roller 13.

Then, while carrying out reciprocating scans integrally with the carriage 2 along the scanning direction, the ink jet head 3 jets ink droplets from the nozzles 35 toward the recording paper 100 being transported by the transport mechanism 4 in the transport direction (toward the downside of FIG. 1) so as to record a desired image on the recording paper 100.

Next, a detailed explanation will be given with respect to the control system of the ink jet printer 1 in reference to the block diagram of FIG. 2. The control unit 8 of the printer 1 shown in FIG. 2 has a microcomputer which includes, for example, a CPU (Central Processing Unit), a ROM (Read Only Memory) in which various programs, data and the like are stored for controlling the overall behavior of the printer 1, a RAM (Random Access Memory) in which data and the like to be processed by the CPU are temporarily stored, etc. The programs stored in the ROM are executed by the CPU to perform various controls as will be explained hereinbelow. Alternatively, the control unit 8 may also be a hardware device in which various circuits including an arithmetic circuit are combined.

Further, the control unit 8 includes a head control section 50 (jetting controller) and a transport control section 51. Based on the image data inputted from a PC 60, the head control section 50 transmits a control signal to the carriage driving motor 19 which drives the carriage 2 and the head driving circuit 20 which drives the actuator unit 31 of the ink jet head 3 so as to control the reciprocating scan of the ink-jet head 3 and the liquid droplet jetting operation of the ink-jet head 3 during the reciprocating scan. On the other hand, the transport control section 51 transmits a control signal to the paper feed motor 14 and paper discharge motor 15 of the transport mechanism 4 so as to control the transport of the recording paper 100 by means of the paper feed roller 12 and paper discharge roller 13. Meanwhile, each function of the head control section 50 and transport control section 51 is, in effect, realized by the behavior of the above-described microcomputer or the behavior of the various circuits including an arithmetic circuit.

Figure 5A:
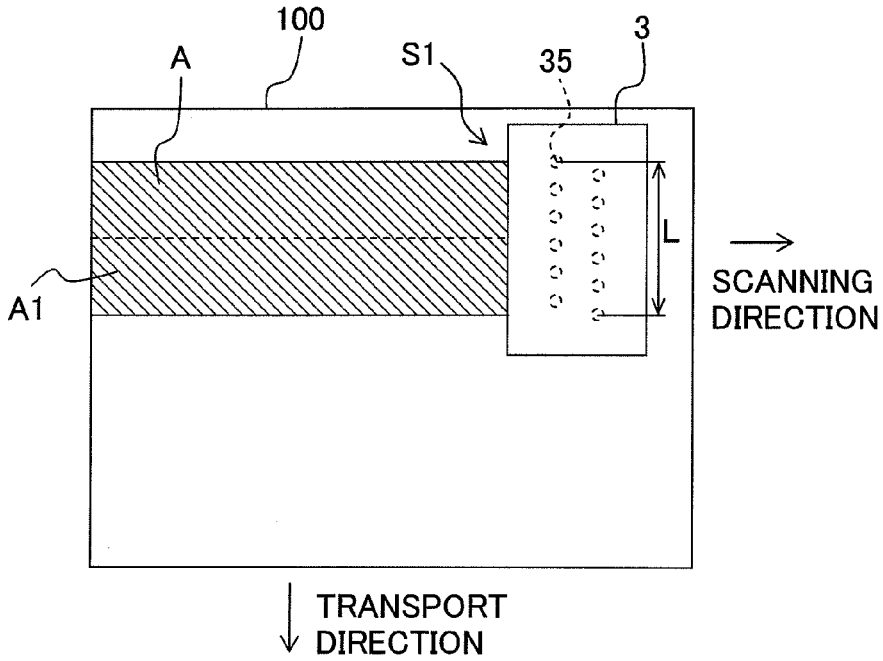
FIG. 5A is a diagram showing a preceding scan of two consecutive scans of the ink-jet head.
Figure 5B:
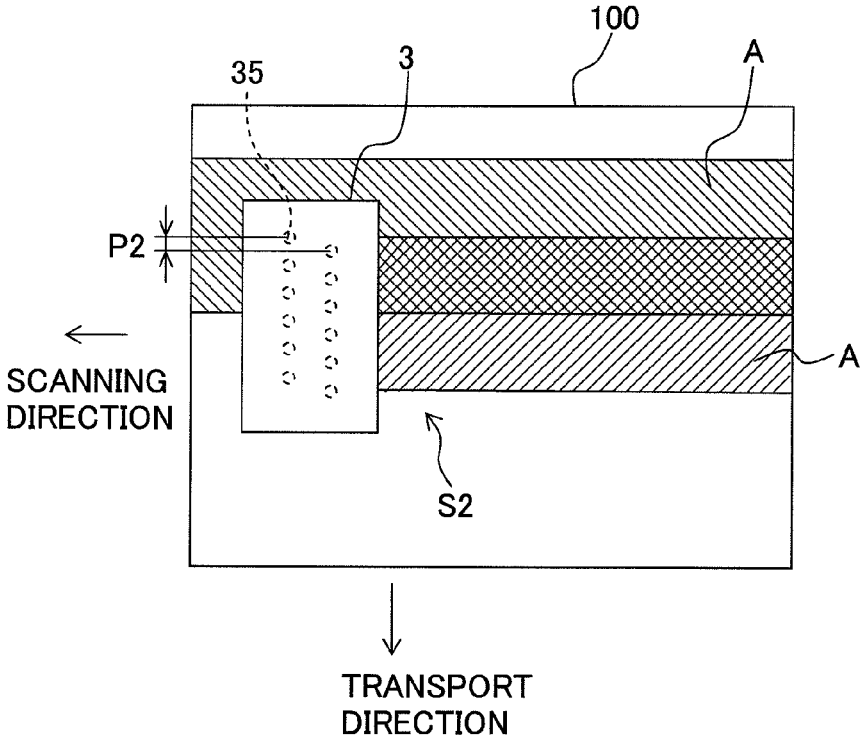
FIG. 5B is a diagram showing the succeeding scan of the two consecutive scans of the ink jet head.

FIGS. 5A and 5B are diagrams showing a motion of the ink jet head 3 in image recording. In the printer 1 of the embodiment as shown in FIG. 5A, first, the head control section 50 controls the carriage driving motor 19 to make the ink-jet head 3 forward scan in one scanning direction (rightward in FIG. 5A) and controls the head driving circuit 20 of the ink-jet head 3 at the same time so that inks are jetted from the nozzles 35 to the recording paper 100. Next, when the ink-jet head 3 arrives at a turning position at which the moving direction of the ink-jet head 3 reverses from rightward to leftward, the transport control section 51 controls the transport mechanism 4 to transport the recording paper 100 in the transport direction with respect to the ink-jet head 3 by a predetermined transport amount or distance. After the moving direction of the ink jet head 3 has changed, as shown in FIG. 5B, the ink-jet head 3 is this time made to backward scan in the other scanning direction (leftward in FIG. 5B) while jetting ink from the nozzles 35 to the recording paper 100. That is, in both scans of the ink-jet head 3 of the one scanning direction (forward scan) and the other scanning direction (backward scan), ink is jetted from the nozzles 35 toward the recording paper 100, in other words, dual direction printing is carried out. In this manner, the above-described forward and backward scans of the ink-jet head 3 are performed alternately a number of times to record a desired image on the recording paper 100.

Further, in each of the forward scan and the backward scan, the length of the liquid droplet jetting area A (first jetting area, second jetting area) on the recording paper 100 in the transport direction is equal to the distance L from the uppermost nozzle 35 to the lowermost nozzle 35 in the transport direction in FIG. 5A. Then, if the transport control section 51 sets a transport amount or distance of the recording paper 100 by the transport mechanism 4 to be shorter than the length L of the liquid droplet jetting area A in the transport direction when the moving direction of the ink jet head 3 is changed, the liquid droplet jetting areas A of the two scans are, as shown in FIG. 5B, partially overlapped (first jetting area is partially overlapped with the second jetting area). At this time, since the dots formed in the succeeding scan are positioned between the dots formed in the preceding scan, it is possible to enhance the print resolution in the transport direction by making the dot interval in the transport direction be narrower than the nozzle layout interval P2.

Figure 11A:
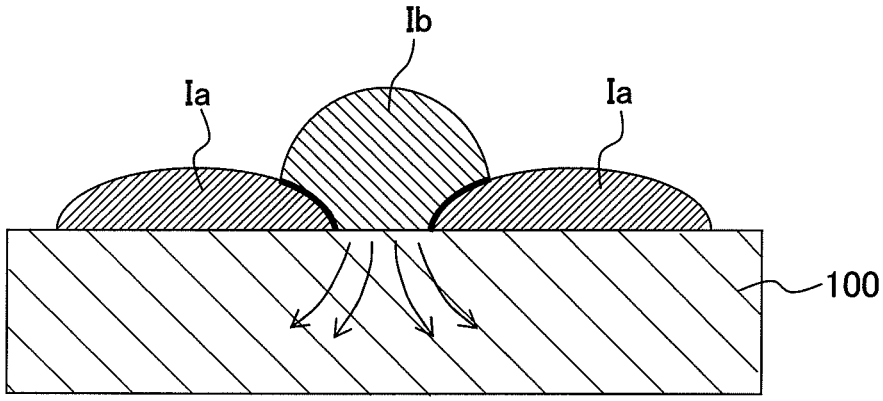
FIGS. 11A and 11B are diagrams for explanation of an influence from drying of the ink of a preceding scan on fixing of the ink of the succeeding scan.
Figure 11B:
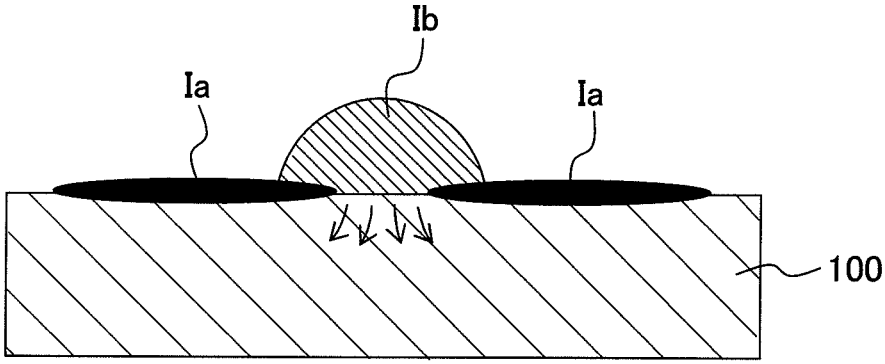
Figure 12:
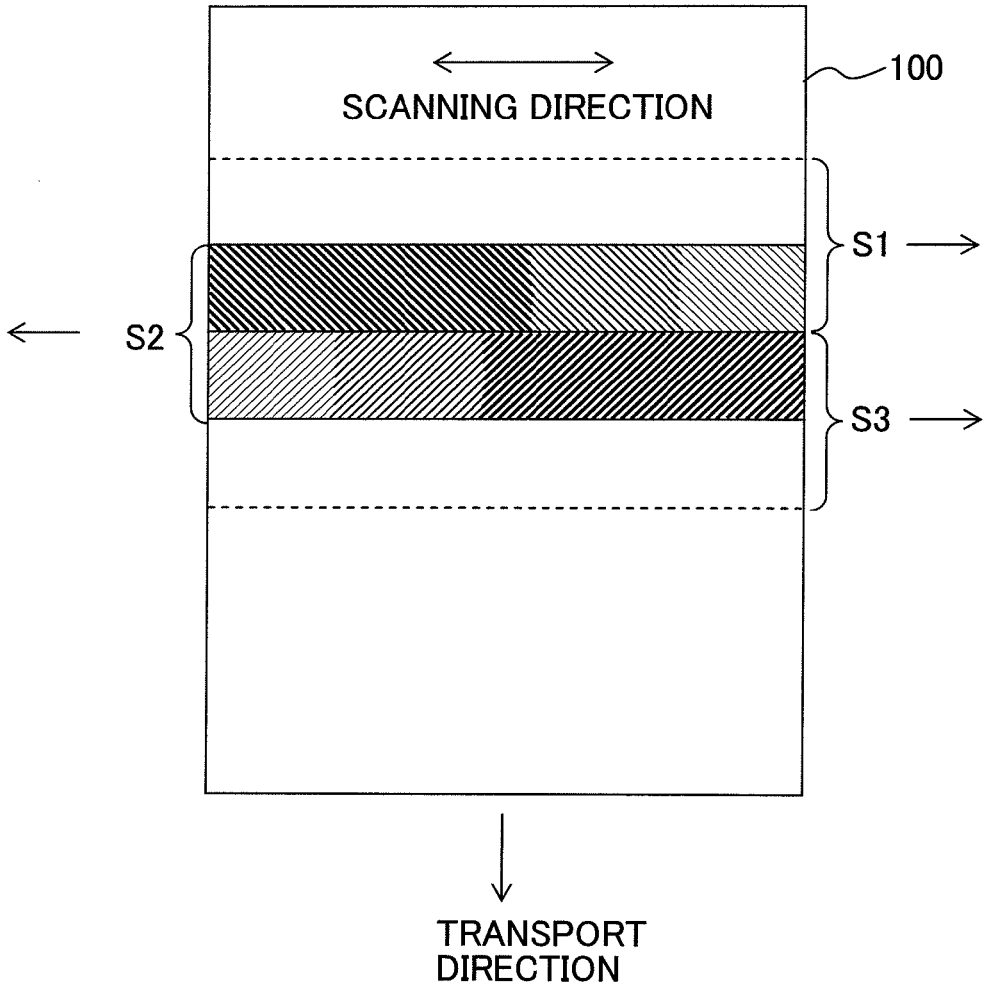
FIG. 12 is a diagram showing a shading of an image formed on a recording medium when three scans of the ink-jet head has consecutively carried out.

As described hereinbefore, if ink is jetted in the succeeding scan in the state that the ink of the preceding scan is not dried, it becomes easy, as shown in FIGS. 11A and 11B, for the succeeding ink to penetrate into the recording paper 100, thereby lowering the density. Further, as coming closer to the turning position at which the moving direction of the ink jet head 3 is changed, the ink of the succeeding scans is more likely to land with the ink of the preceding scans still remaining in an almost undried state. That is, because the dry condition of the preceding ink is not uniform in the scanning direction, shading may occur in the image as shown in FIG. 12.

To address the above problem, the printer 1 of the embodiment reduces the jetting amount of the ink in the preceding scan such that more of the ink jetted in the succeeding scan may land directly on the recording paper 100 instead of on the preceding ink. A detailed description will be made hereinbelow with respect to a particular configuration therefor.

As shown in FIG. 2, the head control section 50 includes a reference jetting amount setting section 52 and a jetting amount adjusting section 53.

As described hereinbefore, in order to form a desired image on a sheet of the recording paper 100, the ink-jet head 3 alternately carries out the forward scan and the backward scan a number of times. Then, based on the image data inputted from the PC 60, the reference jetting amount setting section 52 sets a reference jetting amount for each of the plurality of scans carried out by the ink-jet head 3 to print the image.

The reference jetting amount set for each scan refers to an ink amount per unit area, which should be jetted to the liquid droplet jetting area of one particular scan. Further, the reference jetting amount also has a distribution or variation in the liquid droplet jetting area of one scan, according to the recording image. That is, within the liquid droplet jetting area of one scan, the reference jetting amount becomes greater for a portion of the image at which the color is deep, whereas the reference jetting amount becomes smaller for a portion of the image at which the color is light.

Then, when the image is recorded in such a manner as with two scans over a predetermined area on the recording paper 100, the reference jetting amount is, for example, set as below for each of the two scans over the predetermined area. First, density information of the predetermined area is acquired from the image data inputted from the PC 60 to determine the total ink amount necessary for jetting to the predetermined area based on the density information. Then, the total ink amount is divided by the number of scans (two) to determine the ink amount which should be jetted to the predetermined area by one scan, that is, the reference jetting amount.

The jetting amount adjusting section 53 applies a correction to the reference jetting amount set by the reference jetting amount setting section 52 for each of the plurality of scans to determine an actual jetting amount. In particular, with respect to the preceding scan S1 shown in FIG. 5A of two scans by which the liquid droplet jetting areas A partially overlap each other, the jetting amount is made to become smaller than the reference jetting amount for an overlapping area A1 in which the liquid droplet jetting area A overlaps that of the succeeding scan S2 shown in FIG. 5B. For example, the actual jetting amount is set to 70% of the reference jetting amount. Or, for the area where the reference jetting amount exceeds a predetermined restriction jetting amount (threshold value) above which shading may occur, the actual jetting amount is reduced to the predetermined restriction jetting amount.

Figure 6A:
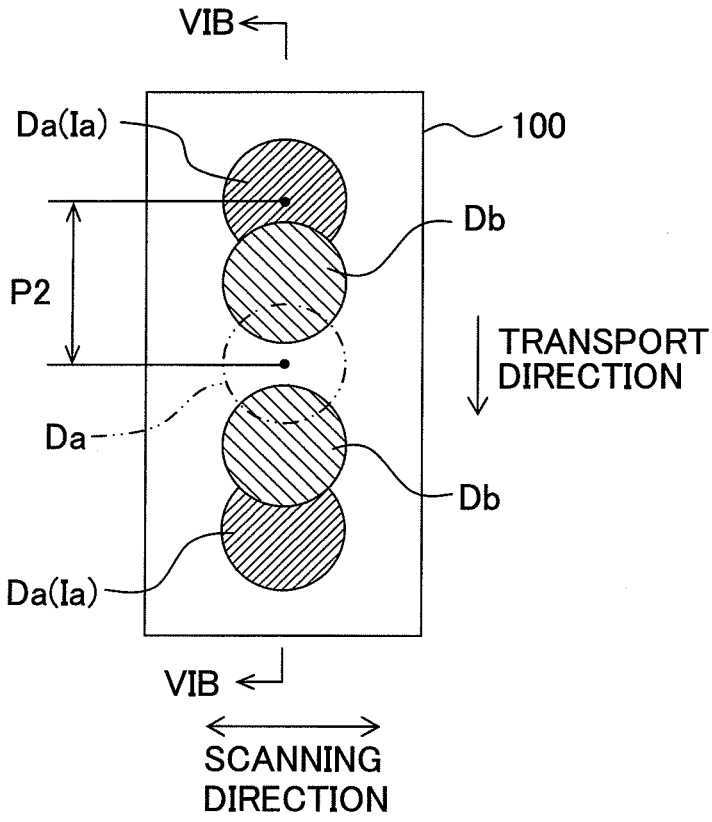
FIG. 6A is a plan view showing dots formed in a preceding scan and dots formed in the succeeding scan on recording paper.
Figure 6B:
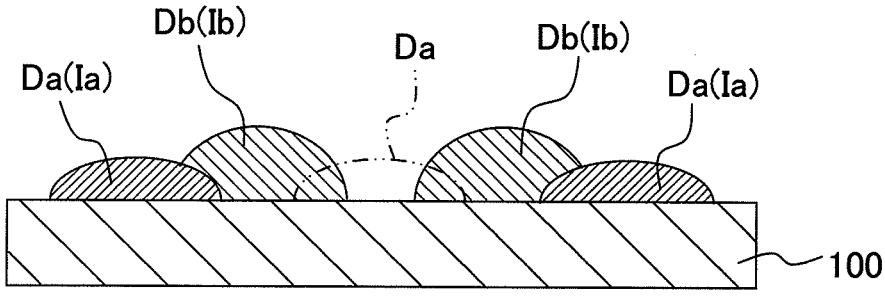
FIG. 6B is a cross-sectional view taken along the line VIB-VIB of FIG. 6A.

As shown in FIGS. 6A and 6B, it is presumed that when the ink is jetted according to the reference jetting amount in the preceding scan, three liquid droplets Da should have been jetted to the positions spaced apart with an equal interval (nozzle layout interval P2) in the transport direction to form three dots. In the embodiment, a liquid droplet Da is not jetted to the central position indicated by the long dashed double-dotted line in FIGS. 6A and 6B, respectively, so as to reduce the number of the liquid droplets Da. Thereby, the actual jetting amount in the preceding scan is made smaller than the reference jetting amount. As a result, at the stage that the preceding scan is finished, the area at which liquid droplet Da is not landed becomes wider in comparison with the case of jetting the reference jetting amount of ink.

Thereafter, the moving direction of the ink-jet head 3 is changed, and the liquid droplets Db jetted in the succeeding scan are landed at the positions P2/2 off with respect to the two liquid droplets Da landed in the preceding scan respectively in the transport direction to form two dots. At this time, because of the wider area without liquid droplet Da landed in the preceding scan, it becomes easy for the liquid droplets Db jetted in the succeeding scan to directly land on the recording paper 100 without overlapping the preceding ink Ia (the liquid droplets Da), and thereby fix on the surface of the recording paper 100. In this manner, the ink Ib (the liquid droplets Db) landed in the succeeding scan overlaps less of the ink Ia jetted previously in quantity. This means that a certain amount or more of the succeeding ink Ib fixes on the surface regardless of the dry condition or degree of the preceding ink Ia. Therefore, even if the dry degree of the ink Ia jetted in the preceding scan is not uniform in the scanning direction, it is still possible to reduce the influence on fixing of the succeeding ink Ib, and thereby to restrain the occurrence of shading.

Further, since it is not necessary to take extra drying time for drying the ink jetted in the preceding scan when the moving direction of the ink jet head 3 is changed, the print speed does not slow down, thereby being most suitable for image recording with a high speed.

Besides, if the jetting amount of the preceding scan is made smaller than the reference jetting amount while the jetting amount of the succeeding scan is, on the other hand, left the same as the reference jetting amount, the total amount of the ink jetted to a certain area (the summation of the jetting amount of two scans) becomes smaller than the predetermined ink amount (which is the base for calculating the reference jetting amount) calculated for the area based on the density information acquired from the image data. Therefore, it is preferable to set the reduction of jetting amount for the preceding scan with respect to the reference jetting amount within an appropriate range such that the density decrease due to the reduction of jetting amount in the preceding scan may not exceed the density decrease due to the penetration of the succeeding ink into the recording paper 100.

Further, if the reference jetting amount of the succeeding scan, which has been determined from the image data, does not reach a maximum jetting amount which is the jetting amount when liquid droplets are jetted from all of the nozzles 35 simultaneously, it is possible to make the jetting amount of the succeeding scan become greater than the reference jetting amount with the maximum jetting amount as an upper limit. In this manner, the jetting amount in the succeeding scan is increased to make up for the reduction of jetting amount in the preceding scan. Thereby, it is possible to secure the ink amount determined based on the image data with the summation of the jetting amount of the preceding and succeeding scans.

Further, although the liquid droplet jetting areas are regarded as partially overlapping each other through the preceding and succeeding scans, in reality, the liquid droplets jetted in the succeeding scan are landed at the positions off from the positions of the liquid droplets jetted in the preceding scan by half of the nozzle layout interval P2 (see FIGS. 3, 5A, and 5B), respectively. Therefore, when no dot is formed at a certain position in the preceding scan so as to reduce the jetting amount while the jetting amount in the succeeding scan is increased, it is not likely to form a dot at completely the same position in the succeeding scan. However, such a minute deviation of the dot does not affect the print quality at all. Rather, the significance resides in the restriction of density decrease due to the reduction of jetting amount in the preceding scan by making the jetting amount for a local area including the dot become equal to the predetermined jetting amount designated from the image data with the summation of the jetting amount of the preceding and succeeding scans.

Next, explanations will be given with respect to a few modifications which apply various changes to the embodiment. However, it should be appreciated that the constitutive parts or components, which are the same as or equivalent to those of the embodiment described hereinabove, are designated by the same reference numerals, any explanation of which will be omitted as appropriate.

Figure 7A:
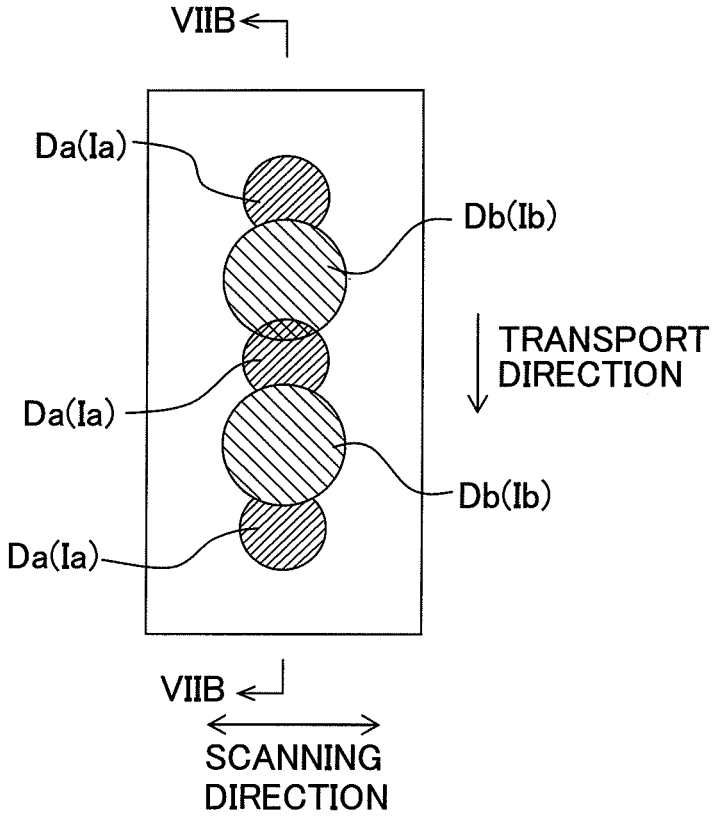
FIG. 7A is a plan view showing dots formed in a preceding scan and dots formed in the succeeding scan on recording paper in accordance with a first modification.
Figure 7B:
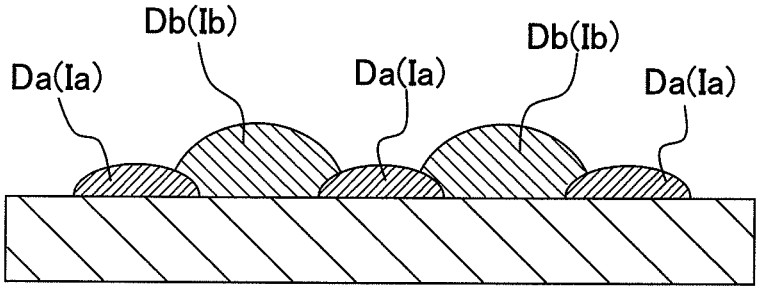
FIG. 7B is a cross-sectional view taken along the line VIIB-VIIB of FIG. 7A.

In the embodiment, the jetting amount in the preceding scan is made smaller than the reference jetting amount by reducing the number of the liquid droplets to be jetted. However, when it is possible to selectively jet a plurality of sorts of liquid droplets different in volume from each of the nozzles 35, the jetting amount may also be made smaller than the reference jetting amount by reducing the volume of each liquid droplet Da jetted in the preceding scan as shown in FIGS. 7A and 7B. Further, the method for jetting the plurality of sorts of liquid droplets different in volume from each of the nozzles 35 has been conventionally known. For example, in the case of jetting liquid droplets from nozzles 35 by the piezoelectric actuator unit 31 of the embodiment (see FIGS. 3 and 4), it is possible to easily implement the method by changing the waveform of the drive pulse signal applied to the individual electrodes 42 from the head driving circuit 20, that is, by altering the timing of switching the voltage between the individual electrodes 42 and the vibration plate 40 as a common electrode, so as to change the energy applied to the ink. Further, it is also possible to alter the voltage value of the driving pulse signal applied to the individual electrodes 42 so as to change the energy applied to the ink. In this case, it is possible to easily implement the method by providing two head driving circuits 20 for supplying the drive pulse signal to the actuator unit 31, and connecting one of the two head driving circuits 20 to the individual electrodes 42 of the actuator unit 31 corresponding to the nozzles 35 positioned on the upstream side in the paper feeding direction and the other to the individual electrodes 42 of the actuator unit 31 corresponding to the nozzles 35 positioned on the downstream side in the paper feeding direction, respectively.

In this manner, by reducing the volume of the liquid droplets Da jetted in the preceding scan, it also becomes easy for the ink Ib jetted in the succeeding scan to directly land on the recording paper 100 instead of on the preceding ink Ia. In addition to that, a small liquid droplet Da in volume brings about a high ratio of surface area with respect to unit volume (unit liquid droplet amount) of the liquid droplet Da, thereby bringing on an effect of drying the liquid droplet Da in a shorter period of time. Therefore, in the case of reducing the volume of each of the liquid droplets Da jetted in the preceding scan, in comparison with the case of reducing the number of liquid droplets Da without changing the size of liquid droplets Da as described in the embodiment hereinbefore, it is easier for the previously jetted ink Ia to get dried before the succeeding scan starts. Thereby, it is possible to reduce the nonuniformity per se in dry condition in the scanning direction of the preceding ink Ia, and thus further restraining the occurrence of shading. Furthermore, it may also be preferable to reduce the jetting amount with respect to the reference jetting amount in the preceding scan by reducing the number of liquid droplets Da together with reducing the volume of each of the liquid droplets Da.

Figure 8A:
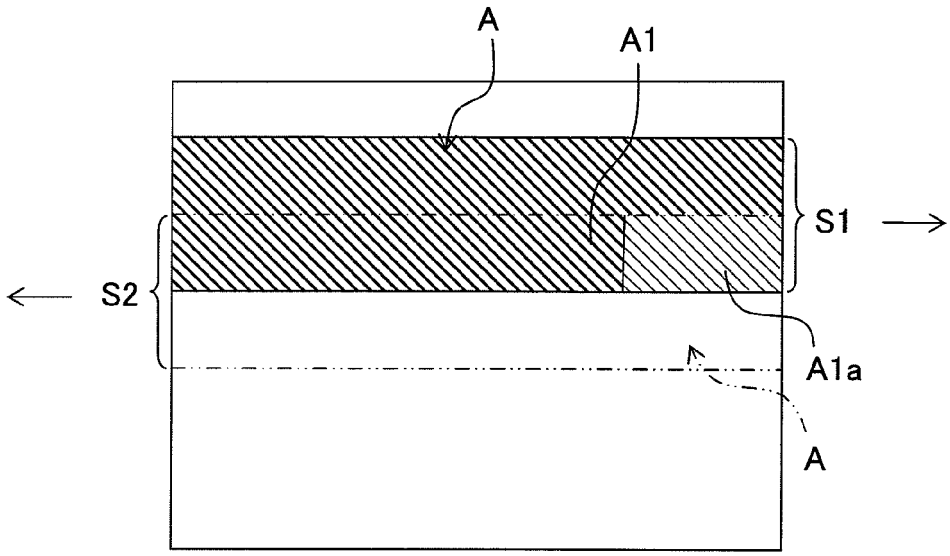
FIG. 8A is a diagram showing a jetting amount restriction method in accordance with a second modification, illustrating an aspect of restricting a jetting amount only in a partial area on a side of turning position.

In the embodiment, in the preceding scan, the jetting amount adjusting section 53 makes the jetting amount become smaller than the reference jetting amount with respect to the entire area in which the liquid droplet jetting area overlaps that of the succeeding scan. However, as has been already described hereinbefore, in the area where the liquid droplet jetting areas overlap each other through two scans, as coming closer to the turning position at which the moving direction of the ink jet dead 3 changes, the ink of the succeeding scans is more likely to be jetted with the ink of the preceding scans still remaining in an almost undried state; thereby the density becomes lower as closer to the turning positions (see FIG. 12). Therefore, as shown in FIG. 8A, the jetting amount adjusting section 53 may also make the jetting amount become smaller than the reference jetting amount only for a partial area A1*a* on the side of the turning position within the overlapping area A1.

Further, in the overlapping area A1, the length, of an area in which the succeeding scan is carried out in a state that the inks jetted in the preceding scan are not dried, from the turning position depends on the scanning speed of the ink-jet head 3 (carriage). Accordingly, it is preferable for the jetting amount adjusting section 53 to determine the range for the partial area A1*a* in which the jetting amount is reduced based on the scanning speed.

Figure 8B:
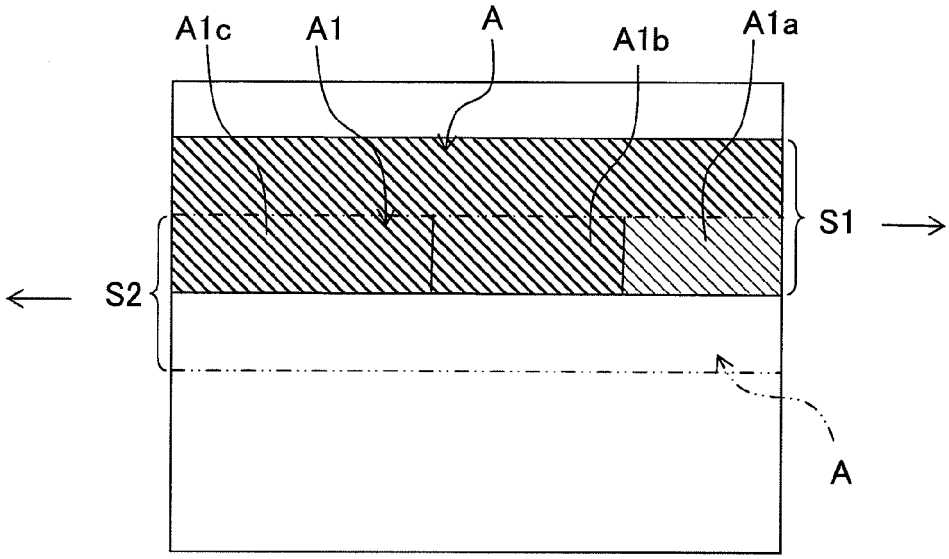
FIG. 8B is a diagram showing the jetting amount restriction method in accordance with the second modification, illustrating an aspect of changing the jetting amount in the scanning direction.

Alternatively, as shown in FIG. 8B, the jetting amount adjusting section 53 may also set the jetting amount for the overlapping area A1 (A1*a*, A1*b*, and A1*c*) smaller as the ink jet head 3 comes closer to the turning position. In particular, in the case of restricting the actual jetting amount in the preceding scan by uniformly multiplying the reference jetting amount by a predetermined reduction rate, the reduction rate is set to be higher as closer to the turning position. Further, in the case of restricting the jetting amount to being equal to or smaller than the predetermined restriction jetting amount only for the area in which the reference jetting amount exceeds a threshold value, the predetermined restriction jetting amount is set to be smaller in value as closer to the turning position. Further, if the reference jetting amount is uniform in the scanning direction, the actual jetting amount also becomes as smaller as closer to the turning position. However, in practice, the reference jetting amount, which is designated from the image density information, is seldom uniform in the scanning direction; therefore, the actual jetting amount does not necessarily become as smaller as closer to the turning position according to the recording images.

Further, the jetting amount adjusting section 53 may also make the jetting amount of the preceding scan become smaller than the reference jetting amount only for the partial area on the side of the turning position in the scanning direction and, further, make the jetting amount be smaller as closer to the turning position in the partial area.

When the ink-jet head 3 is capable of jetting multiple sorts of inks such as a color ink jet head and the like which jet multicolor inks, the ink drying time and the ink penetration speed into the recording paper 100 vary due to the characteristics of the inks jetted. Further, the observability of shading varies depending on the colors (for example, it is more difficult to observe the shading of light-colored ink such as yellow). Further, in the case of utilizing multiple sorts of the recording paper 100 different in the conditions such as paper quality, surface treatment and the like, the ink drying time and the ink penetration speed into the recording paper 100 also vary depending on the sorts of the recording paper 100. Therefore, it is also possible to appropriately change the degree of reducing the jetting amount from the reference jetting amount in the preceding scan, or the range of the area of making the jetting amount become smaller than the reference jetting amount, etc., according to the sorts of the inks and the recording paper 100.

In the embodiment, each area of the image is formed by (partially) overlapping two scans. However, it may also be formed by overlapping more than two scans. In such case, the jetting amount is made smaller with respect to the reference jetting amount as for the scan carried out further previously among the more than two scans.

Next, descriptions will be made with respect to the following two specific working examples (1) and (2) of the present invention, respectively.

A working example (1) of the method for reducing the jetting amount with respect to the reference jetting amount will be described below. As preconditions, it is provided that the nozzle layout interval P2 in the transport direction (see FIG. 3) is 300 dpi, and the resolution of the recording image was 600 dpi (scanning direction)×600 dpi (transport direction). Further, the drive frequency of the actuator (the reciprocal of the jetting period of liquid droplet) is 26 kHz, and thus the head scanning speed comes up to 43.3 ips from the above resolution of the scanning direction and the drive frequency of the actuator. It is possible to jet three types of liquid droplets different in volume (large droplet, medium droplet, and small droplet) from one nozzle, and the volumes of the large droplet, medium droplet and small droplet are: 16 pl, 5 pl, and 3 pl, respectively.

Jetting amount restriction for preventing the occurrence of shading will be described bellow. Under the above preconditions, reciprocating scan was repeatedly carried out over plain paper (normal paper) with a jetting amount of jetting large droplets from all nozzles across the whole area in the scanning direction (100% duty). Here, since the resolution in the scanning direction is 600 dpi, the maximum dot number per inch is 600 dots. When these 600 dots are all formed of large droplets, the jetting amount is 16 pl×600 dot=9,600 pl. Consequently, shading was visually confirmed as occurring in the print result. On the other hand, when the jetting amount in the preceding scan was restricted to 70% or less of that of jetting large droplets from all the nozzles, that is, when the jetting amount was 9,600 pl×0.7=6,720 pl or less, shading could not be visually confirmed in the print result. Further, when all dots were formed of small or medium droplets, the jetting amount per inch is: 3 pl (small droplet)×600 dot=1,800 pl and 5 pl (medium droplet)×600 dot=3,000 pl, respectively. Neither of them reached the above-described restriction jetting amount (6,720 pl), and shading could not be visually confirmed in the print results. From these results, it can be known that when the scanning speed is constant, the jetting amount in the preceding scan may be reduced from the reference jetting amount more greatly as the jetting liquid droplets become greater in volume. Further, in the embodiment, plain paper is utilized. Nevertheless, if other recording paper which has been through surface treatment and thus has a shorter drying time than plain paper is used, the jetting amount in the preceding scan may also be set to be greater than that in utilizing plain paper.

As a specific method for the above-described restriction of jetting amount, it is possible, as has also been shown in the embodiment, to select from these two choices: to reduce the number of dots (liquid droplets) and to reduce the size of each dot (liquid droplet volume). If the number of large droplets is reduced to 70%, then the jetting amount amounts to 16 pl×600×0.7=6,720 pl/inch. On the other hand, if a part of large droplets are changed to medium droplets and the dot number remains unchanged, for example, 45% of the dots are changed from large droplets to medium droplets, then the jetting amount amounts to 16 pl (large droplet)×600×0.55+5 pl (medium droplet)×600×0.45=6,630 pl/inch, thereby being able to satisfy the requirement for not exceeding the restriction value 6,720 pl/inch.

Figure 9:
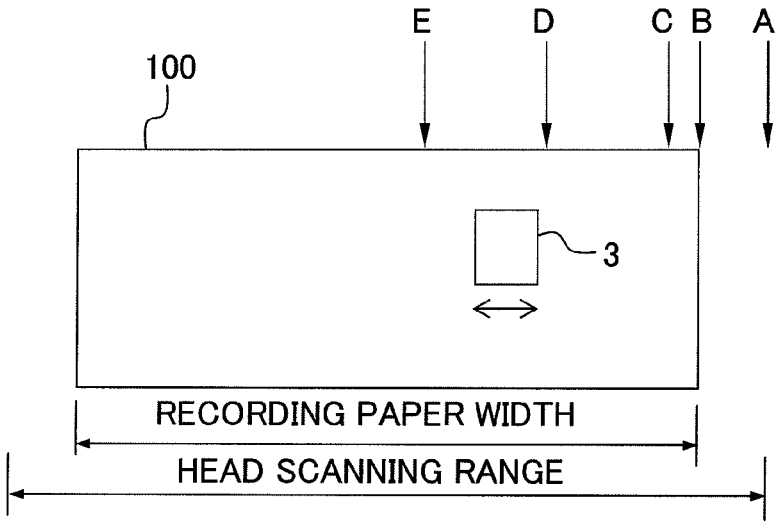
FIG. 9 is a diagram showing head positions (A to E) in accordance with a working example.

A working example (2) of changing the restriction value of jetting amount in the scanning direction will be described bellow. FIG. 9 is a diagram showing a representative position of the ink-jet head 3 which moves in a reciprocating manner in a scanning direction, wherein A indicates the turning position on the right side; B indicates the right edge of the recording paper 100; C indicates the right edge of the recording area on the recording paper 100; D indicates a position one inch away from the right edge of the recording paper 100 (B) to the left; and E indicates a position two inches away from the right edge of the recording paper 100 (B) to the left. Further, the distance, between the right edge of the recording paper 100 B and the right edge of the recording area C, is 0.05 inch. This distance also indicates the margin portion of the periphery of the image.

Then, as preconditions, it is provided that the nozzle layout interval P2 in the transport direction (see FIG. 3) is 300 dpi, the image resolution is 600 dpi (scanning direction)×600 dpi (transport direction), and the scanning speed is 43.3 ips. Under these preconditions, the ink jet head 3 is made to scan in the rightward direction and then to scan in the leftward direction after turning at the position A. Meanwhile, the jetting amount in the preceding scan (rightward scan) is altered with respect to 100% duty according to the three positions in the scanning direction (C, D, and E) whereas the succeeding scan is carried out on 100% duty. Then, examinations were made on the jetting amount with which shading had not occurred at the positions C, D, and E, and the results are shown in Table 1.

TABLE 1

| Condition | Scanning speed (ips) | Head position | Distance from right edge B (inch) | Turning time (sec) | Drying time (sec) | Jetting amount restriction | Restriction jetting amount (pl/inch) |
|---|---|---|---|---|---|---|---|
| 1 | 43.3 | C | 0.05 | 0.05 | 0.052 | 0.70 | 6,720 |
| 2 | 43.3 | D | 1 | 0.05 | 0.096 | 0.90 | 8,640 |
| 3 | 43.3 | E | 2 | 0.05 | 0.142 | 1.00 | 9,600 |

Table 1 shows that when the head position is any one of the positions C, D, and E of FIG. 9 and the jetting amount at each of the head positions in the preceding scan was restricted down to the duty described in the jetting amount restriction column, density reduction did not occur at the head position (the density did not become lower in comparison with the area on the left side of the head position). For example, the condition 1 shows that when the jetting amount at the right edge of the recording area C was at 70% of 100% duty (9,600 pl/inch) in the preceding scan (rightward scan), density reduction did not occur at the position C after the succeeding scan was finished. Further, the condition 2 shows that when the jetting amount at the position D was at 90% of 100% duty in the preceding scan, density reduction did not occur at the position D. Further, the condition 3 shows that at the position E, density reduction did not occur even though the jetting amount of the preceding scan was not restricted.

The turning time in Table 1 is the period of time for the movement of B→A→B in FIG. 9. Further, the drying time is the summation of the turning time and the time for a round trip between the head position (any one of C, D, and E) and the right edge B, indicating the period of time from the landing of ink at the above head position in the preceding scan (rightward scan) to the landing of ink at the same head position in the succeeding scan (leftward scan). For example, if the condition 2 is concerned, the head position is D, and thus the distance to the right edge B is one inch. Therefore, first, the time for the round trip between the head positions D and B is: 1 inch×2/43.3 ips=0.046 sec. With the addition of the turning time 0.05 sec, the drying time amounts to 0.096 sec.

Figure 10:
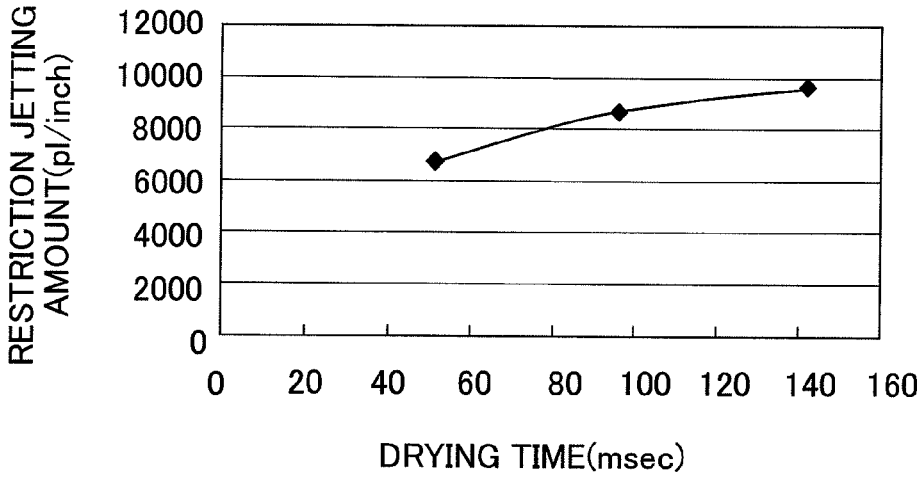
FIG. 10 is a graph showing a relationship between drying time and restriction jetting amount in accordance with the working example.

The curve of FIG. 10 shows a relation between the drying time and the restriction jetting amount of Table 1, wherein x (msec) represents the drying time and y (pl/inch) represents the restriction jetting amount. The curve of FIG. 10 can be approximated by the quadratic function: $y=-0.255x^2+81.63x+3147.9$. From this relation, it is possible to deduce a restriction jetting amount of the preceding scan such that density reduction may not occur at the head position in the case of changing the parameters of scanning speed and head position. An example will be shown in Table 2.

TABLE 2

| Condition | Scanning speed (ips) | Head position | Distance from right edge B (inch) | Turning time (sec) | Drying time (sec) | Jetting amount restriction | Restriction jetting amount (pl/inch) |
|---|---|---|---|---|---|---|---|
| 4 | 21.7 | C | 0.05 | 0.05 | 0.055 | 0.71 | 6,845 |
| 5 | 21.7 | D | 1 | 0.05 | 0.142 | 1.00 | 9,599 |
| 6 | 21.7 | E | 2 | 0.05 | 0.234 | 1.00 | 9,600 |
| 7 | 57.7 | C | 0.05 | 0.05 | 0.052 | 0.70 | 6,688 |
| 8 | 57.7 | D | 1 | 0.05 | 0.085 | 0.86 | 8,231 |
| 9 | 57.7 | E | 2 | 0.05 | 0.119 | 0.96 | 9,258 |

In Table 2, the scanning speed is changed in contrast to Table 1 and, as a result, the drying time differs for a same head position. Then, the restriction jet quantities are calculated by substituting these drying times into the above relational expression. The value in the column of jetting amount restriction is the result of dividing the restriction jetting amount calculated from the relational expression by the jetting amount of 100% duty (9,600 pl). As known from Table 2, for the condition 5 with the slower scanning speed, it is not necessary to restrict the jetting amount even if the head position is at the position D; on the contrary, for the condition 9 with the higher scanning speed, it is necessary to restrict the jetting amount even if the head position is at the position E. However, the above working example is no more than an example; therefore, it is preferable to change the restriction jetting amount according to the type of ink and the type of recording paper 100.

What is claimed is:

1. An image recording apparatus which records an image by jetting liquid droplets of an ink onto a recording medium, the apparatus comprising:

an ink-jet head which jets the liquid droplets of the ink onto the recording medium;

a scanning mechanism which reciprocates the ink-jet head in a forward scan direction and a backward scan direction to perform forward scan and backward scan of the ink-jet head;

a transport mechanism which transports the recording medium in a transport direction intersecting with the forward scan direction and the backward scan direction; and a controller configured to:

control the scanning mechanism to perform the forward scan and the backward scan of the ink-jet head;

control the ink-jet head to jet the liquid droplets on a first jetting area and a second jetting area on the recording medium which are formed by the forward scan and the backward scan of the ink-jet head, respectively;

control the transport mechanism to transport the recording medium in the transport direction;

set a transporting amount of the recording medium by the transport mechanism to be smaller than a length of the first jetting area in the transport direction, and control the transport mechanism to transport the recording medium by the transporting amount when scanning direction of the ink-jet head is changed from the forward scan direction to the backward scan direction, so that the first jetting area is partially overlapped with the second jetting area;

set a reference jetting amount of the liquid droplets based on an input image data for each of the forward scan and the backward scan of the ink-jet head performed when the image is to be recorded on the recording medium; and make a jetting amount of the liquid droplets during the forward scan of the ink-jet head smaller than the reference jetting amount with respect to an overlapping area at which the first jetting area is overlapped with the second jetting area.

2. The image recording apparatus according to claim 1;

wherein during the backward scan of the ink-jet head, the controller is configured to make the jetting amount with respect to the overlapping area be greater than the reference jetting amount.

3. The image recording apparatus according to claim 1;

wherein during the forward scan of the ink-jet head, the controller is configured to reduce a number of the liquid droplets to be jetted onto the overlapping area to make the jetting amount with respect to the overlapping area be smaller than the reference jetting amount.

4. The image recording apparatus according to claim 1;

wherein during the forward scan of the ink-jet head, the controller is configured to reduce a volume of the liquid droplets to be jetted onto the overlapping area to make the jetting amount with respect to the overlapping area be smaller than the reference jetting amount.

5. The image recording apparatus according to claim 1;

wherein during the forward scan of the ink-jet head, the controller is configured to make the jetting amount be smaller than the reference jetting amount with respect to a partial area, of the overlapping area, located in the vicinity of a turning position at which the scanning direction of the ink-jet head is changed from the forward scan direction to the backward scan direction.

6. The image recording apparatus according to claim 5;

wherein the controller is configured to determine a length of the partial area from the turning position in the backward scan direction, based on a reciprocation speed of the ink-jet head.

7. The image recording apparatus according to claim 1;

wherein during the forward scan of the ink-jet head, the controller is configured to make the jetting amount with respect to the overlapping area smaller as the ink-jet head comes closer to the turning position.

8. The image recording apparatus according to claim 1;

wherein, when the controller sets the reference jetting amount to be greater than a predetermined threshold value, the controller is configured to make the jetting amount with respect to the overlapping area smaller than the reference jetting amount.

9. The image recording apparatus according to claim 1;

wherein the ink includes a plurality of color inks;

wherein the controller is configured to set the reference jetting amount for each of the color inks; and wherein during the forward scan of the ink-jet head, controller is configured to make the jetting amount for each of the color inks smaller, with respect to the overlapping area, than the reference jetting amount of one of the color inks.

* * * * *